United States Patent [19]

Cameron

[11] 4,227,547

[45] Oct. 14, 1980

[54] VALVE SAFETY INDICATING MEANS

[75] Inventor: Russell J. Cameron, Rochester, Mich.

[73] Assignee: Ross Operating Valve Company, Detroit, Mich.

[21] Appl. No.: 11,140

[22] Filed: Feb. 12, 1979

Related U.S. Application Data

[60] Division of Ser. No. 910,492, May 30, 1978, abandoned, which is a continuation of Ser. No. 729,273, Oct. 4, 1976, abandoned.

[51] Int. Cl.[3] ..... F15B 20/00

[52] U.S. Cl. ..... 137/554; 91/424; 137/596.16; 251/364

[58] Field of Search ..... 91/424; 137/554, 596.16; 251/364

[56] References Cited

U.S. PATENT DOCUMENTS 473,488 4/1892 Wood ..... 137/554 X

*Primary Examiner*—Gerald A. Michalsky

*Attorney, Agent, or Firm*—Harness, Dickey & Pierce

[57] ABSTRACT

Means for sensing a discrepant position between two normally closed valves of a double valve assembly used to control an industrial machine such as an air-operated press clutch and brake. The indicating means comprises switch means responsive to the movement of each of the valves and so positioned that the switch means is actuated very close to the closed position of each valve. The switch means controls power to solenoid-operated pilot valves for the two main control valves of the double valve assembly. By controlling the switch means immediately adjacent the closed valve positions, the safe or closed part of the cycle is monitored for these valves, which are in themselves stable because of their normally closed nature. The switch means may be either cam-operated mechanical switches, proximity switches, photoelectric sensors, or contacts directly engageable by the inlet valve elements and utilizing the valve body itself as part of the electrical circuit. The invention is applicable to a double valve assembly in which both inlet and exhaust flow is in parallel through the two valves, or one in which the inlet flow is in series and the exhaust flow in parallel.

4 Claims, 9 Drawing Figures

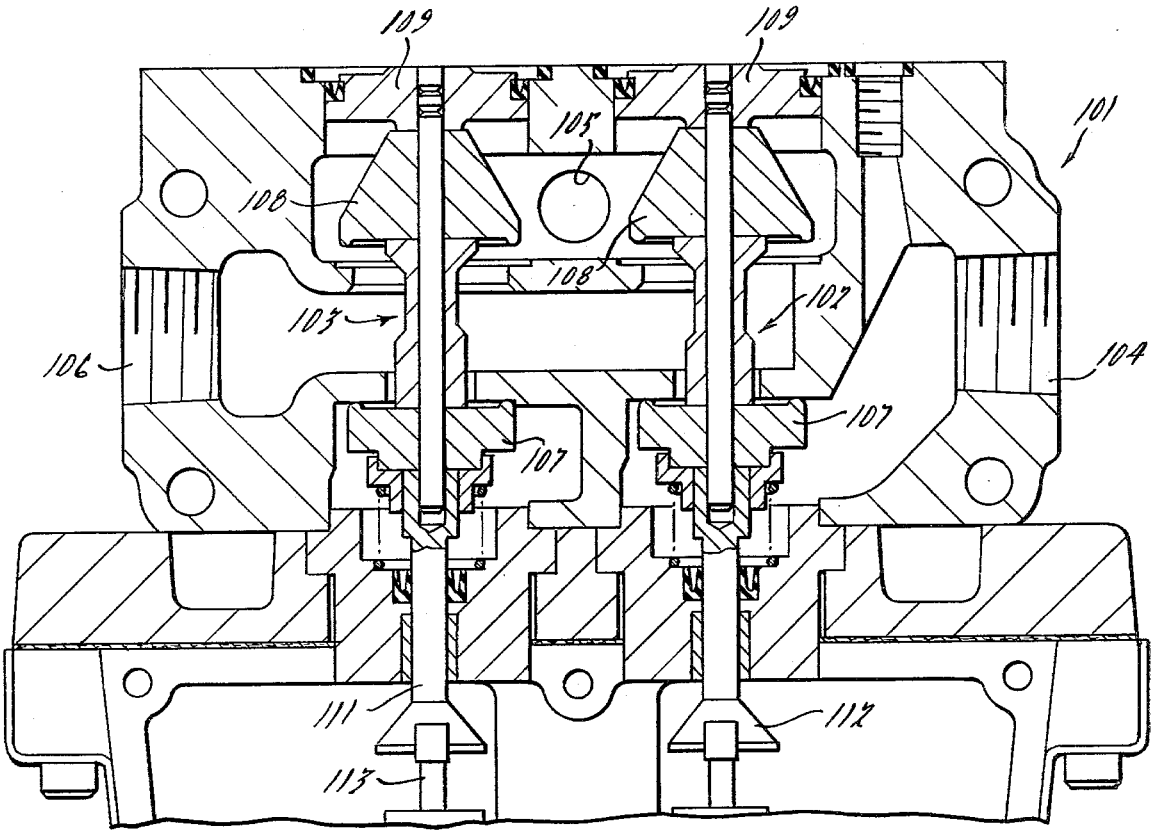
FIG. 4.
FIG. 3.
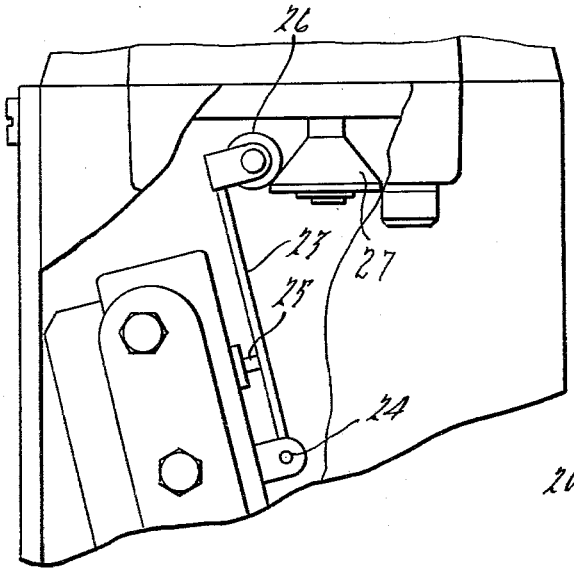
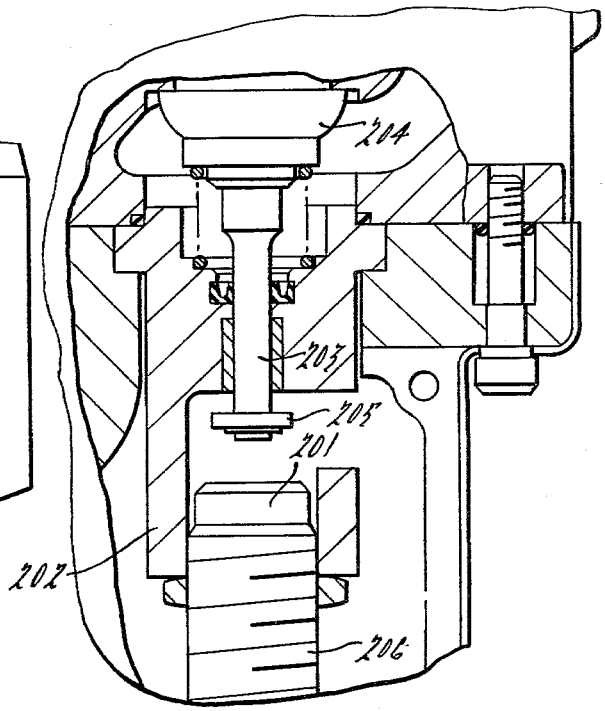
FIG. 5.

Operator Push Buttons

VALVE SAFETY INDICATING MEANS

This is a division of application Ser. No. 910,492, filed May 30, 1978, now abandoned, which in turn is a continuation of application Ser. No. 729,273, filed Oct. 4, 1976, now abandoned.

BACKGROUND OF THE INVENTION

1. Field of the Invention

The invention relates to double valve assemblies used for safety purposes in connection with industrial equipment such as presses, and more particularly, to means for indicating discrepant positions between the two valves of the double valve assembly. Double valve assemblies of this type are disclosed in Di Tirro et al U.S. Pat. No. 2,906,246. Mahorney et al U.S. Re. Pat. No. 28,520, Sweet U.S. Pat. No. 3,757,818 and Cameron U.S. Pat. No. 3,858,606. They are of two general types. In the first type, two three-way valves are so arranged that both inlet and exhaust flows to and from the working port are in parallel through the two valves. The second type is so arranged that the inlet flow is in series through the two valves but the exhaust flow is in parallel. In both cases the valves are piston operated and controlled by solenoid-operated pilot valves.

2. Description of the Prior Art

It is known to control switch means in accordance with the positions of the two valve stems, the switch means controlling an indicator or other safety or anti-repeat circuits which will de-energize the solenoid and stop the press. Such switch means is shown, for example, in Mahorney et al U.S. Re. Pat. No. 28,520. This patent shows piston-operated normally closed main control valves for a double valve assembly, controlled by normally closed solenoid-operated pilot valves. The switch means, however, is so arranged as to be operated when the three-way valves are in a partially or fully open position. Such a position is relatively unsafe since when the valves are open, they normally have actuated an air-operated clutch which drives the press through its cycle, whereas when the valves are closed (in their exhaust position), the air cylinder which operates the clutch and brake is also exhausted, thus applying the brake and holding the press at the top of its stroke.

Other somewhat less pertinent patents in this field are Ruchser U.S. Pat. No. 3,139,109 and Herion German Pat. No. 1,057,209, published May 14, 1959.

A double valve assembly manufactured by Bellows-Valvair, Akron, Ohio (Bulletin CP3082, Model Nos. 219700-01) does have switch means so located as to be actuated when the two main control valves reach their closed or safe positions, but the Valvair main control valves are constantly urged to their open positions, the solenoid-operated pilot valves being open when the solenoids are de-energized so that the main valves are held closed. The main valves however, since they are constantly urged to their open positions, are considered relatively unsafe or unstable as compared with normally closed main valves since, without piston pressure being applied to the main control valves, they will revert to an open position, making it possible to have inadvertent operation of the air cylinder or the press clutch.

BRIEF SUMMARY OF THE INVENTION

It is an object of the present invention to provide a novel and improved indicating means for double valve assemblies which overcome the disadvantages of previously known constructions and provides a direct means for monitoring the fact that the two valves are in a safe position.

It is another object to provide an improved indicating means of this nature which utilizes relatively safe or stable (normally closed) main control valves and senses the safe part of the cycle controlled by said valves, thus providing a positive indication of the safety of the apparatus.

It is also an object to provide an indicating means of this character which is capable of utilizing various types of switch means and, in one embodiment, of using the valve body itself as a portion of the electrical circuit.

It is a further object to provide an improved indicating means of this nature which may be used in conjunction with a double valve assembly of the parallel type or one of the series-parallel type.

Briefly, the invention is used in combination with a double valve assembly having a pair of piston-operated main control valves, solenoid-operated means for each of said main control valves, the valves being in a closed position when their pistons are depressurized and said solenoids are de-energized, and switch means for each of said main control valves actuatable between first and second positions when said control valves move between their open and closed positions, the improvement comprising means mounting the switch means for each main control valve so that said switch means moves from its first to its second position immediately upon the first increment of movement of said main control valve away from its fully closed position, and moves from its second to its first position immediately upon the last increment of movement of said main control valve toward its fully closed position.

BRIEF DESCRIPTION OF THE DRAWINGS

FIG. 3 is a side elevational view of the apparatus of FIG. 2, partially broken away;

FIG. 4 is a partial cross-sectional view in elevation showing a parallel double valve with mechanical limit switches constructed according to the invention;

FIG. 5 is a partially schematic sectional view showing a modified form of the invention, with a proximity switch used instead of the mechanical limit switches;

DESCRIPTION OF THE PREFERRED EMBODIMENTS

Figure 1:
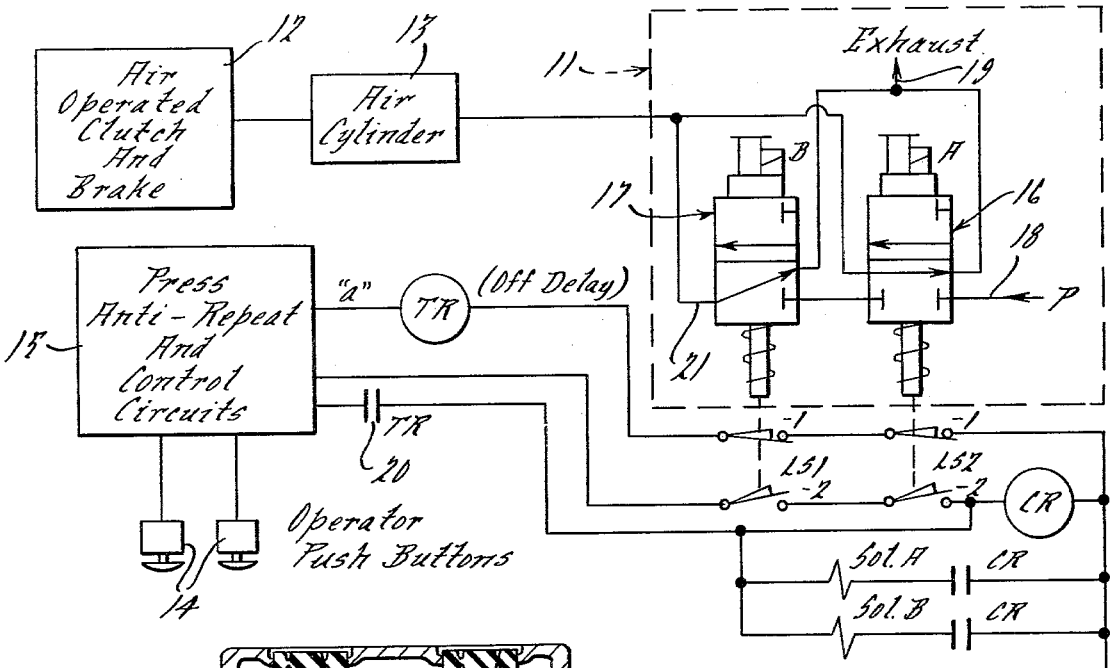
FIG. 1 is a schematic view showing the invention applied to a series-parallel type double valve assembly and also showing the air-operated clutch and brake and the press control circuit in schematic form.

FIG. 1 discloses schematically a double valve assembly generally indicated at 11 for controlling a clutch and brake unit 12 which is operated by an air cylinder 13. The clutch and brake may, for example, be for a press (not shown), and the clutch is energized in response to the pressing of operator push buttons 14 to drive the movable press element downwardly and then retract it upwardly, at which point it is held in its uppermost position by de-energization of the clutch and actuation of the brake. Typically, the clutch is energized by pressurization of air cylinder 13 and the brake actuated by exhausting the cylinder. The press anti-repeat and control circuits are represented schematically at 15 and are of a conventional nature, responding to signals such as those emitted by the novel switch means of this invention to de-energize the double valve assembly 11 and stop the press in its uppermost position should certain unsafe conditions arise.

Figure 2:
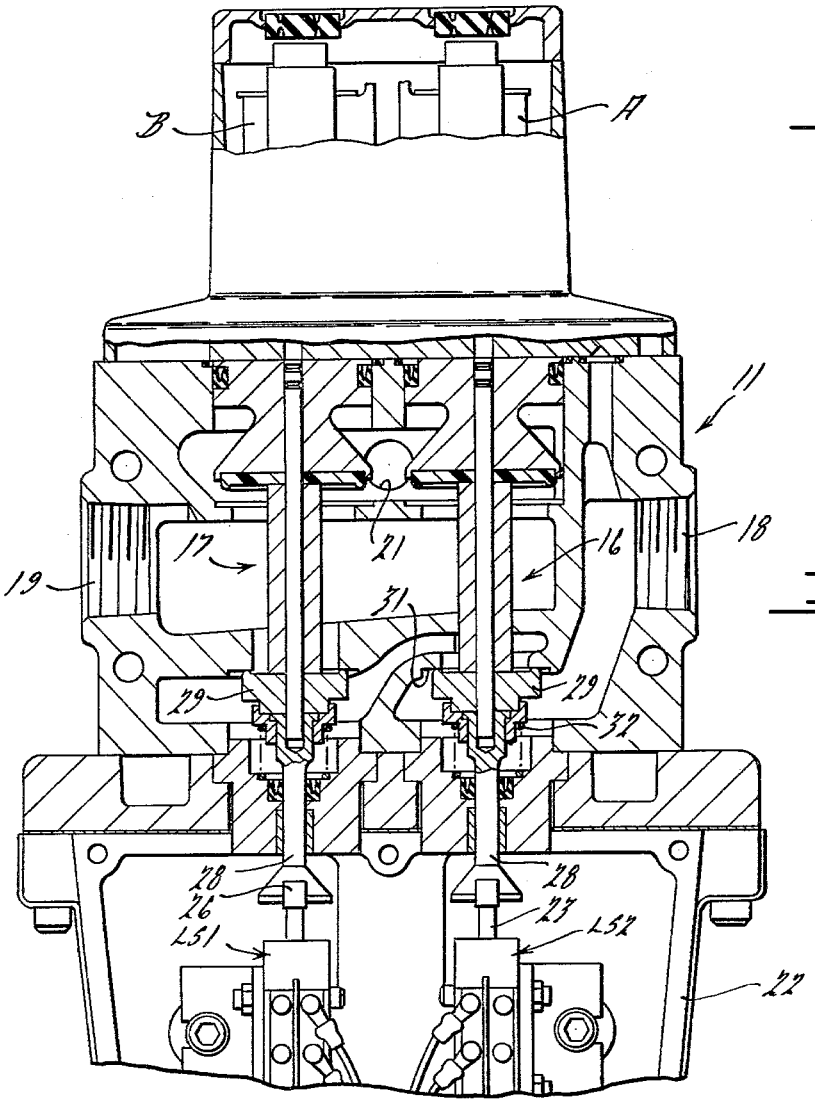
FIG. 2 is a cross-sectional view in elevation showing how the individual valve stems are connected to the two switch means which are in this case cam-operated mechanical limit switches.

The two valves of the double valve assembly are, conventionally, normally closed piston-operated three-way poppet valves, as shown in FIGS. 2 and 4. FIGS. 1 and 2 are compatible in that the inlet portions of the two valves are connected in series and the exhaust portions in parallel, as shown for example in said Sweet U.S. Pat. No. 3,757,818. In FIG. 4 both the inlet and the exhaust portions of the two valves are in parallel, as described in Di Tirro et al U.S. Pat. No. 2,906,246. In both cases, however, the arrangement is such that when the pistons of the valves are unpressurized, the valves with be held by springs in their closed positions, meaning that their inlet valve members will be held against their seats and their exhaust valve members held away from their seats. Pressurization of the pistons will cause the inlet valve members to move away from their seats and the exhaust valve members to approach their seats.

The pressure to the pistons of the valves is controlled by solenoid-operated pilot valves, indicated at A and B for the two valves generally indicated at 16 and 17 respectively in FIG. 1. The solenoid-operated valves are normally closed, that is, they are three-way valves which are in their exhaust position when their solenoids are de-energized and in their supply position when the solenoids are energized. The supply positions means that pressure will be applied to the pistons of their respective main valves whereas the exhaust positions referred to are de-pressurizing of these pistons. It is the solenoids A and B of the pilot valves which are controlled by the switch means of this invention.

It will be noted from FIG. 1 that when valves 16 and 17 are in their closed or exhaust positions as shown in that figure, the system is relatively safe since the pressurized air from supply port 18 is cut off and air cylinder 13 is connected to exhaust port 19. It is the purpose of this invention to ensure that, should a discrepant position between valves 16 and 17 develop, this safe condition will be attained to the fullest extent possible.

Switches LS1 and LS2 are actuated by movement of valves 17 and 16 respectively. These two switches are conventional in themselves but in accordance with the present invention, their shifting is accomplished by the initial small increment of movement of either valve away from its closed position, and shifted back immediately before the valve reaches its closed position. Each switch has two contacts, numbered 1 and 2, the number 1 contacts being in series as are the number 2 contacts. A timing relay TR is connected to an output signal "a" from the control circuits 15 and in series with contacts 1 of the two switches. When energized, relay TR will close normally open contacts 20 which are in series with a relay CR. This relay controls normally open contacts in series with solenoids A and B respectively. A holding circuit is provided for relay CR through contacts 2 of the two switches LS1 and LS2.

In operation, LS1 and LS2 are held closed when valves 16 and 17 are in their closed positions. A signal to "a" from the press control circuit responsive to pushing of buttons 14, 15 energizes TR, closing the normally opened TR contacts 20. This will energize CR which supplies power to solenoids A and B, causing valves 16 and 17 to shift to their open positions. If both valves actuate normally, LS2-2 and LS1-2 close while LS2-1 and LS1-1 open. Closure of switches contact LS2-2 and LS1-2 provides the holding circuit for relay CR and the press will continue to go through its cycle. Opening of switches LS1-1 and LS2-1 will de-energize relay TR, and after a delay, contacts 20 will open.

If either valve 16 or 17 fails to shift from its closed position, the holding circuit is not completed and as soon as time delay relay TR times out, solenoids A and B will be deenergized and valves 16 and 17 will shift back to their closed or exhaust positions. The only delay before shut-down is thus the delay caused by time delay relay TR. If switches LS1 and LS2 were not actuated until valves 17 or 16 had travelled a substantial distance toward their fully open positions, as in the conventional construction the delay would be substantially greater, since relay TR would not be de-energized as quickly.

Assuming the valves both open normally, the press control circuit will in the normal course of the cycle de-energize relay CR which will in turn de-energize solenoids A and B. This will cause the valves 17 and 16 to shift to their closed or exhaust positions. If either valve fails to fully close, the corresponding switch contact LS1-1 or LS2-1 will not close. This means when the next signal a is given, relay TR will not be energized and relay CR will therefore not power the solenoids. It should be noted that in the case of both valves opening but one valve only shifting partway toward its fully open position, the result will be slower actuation of the press, but the press will be stopped due to the discrepancy just as quickly as before.

FIGS. 2 and 3 show the construction of valve assembly 11 and valves 16 and 17 thereof as well as the manner in which switches LS1 and LS2 are connected to the valves. The construction of valve assembly 11 is similar to that shown in the aforementioned U.S. Pat. No. 3,757,818, including inlet port 18, working port 10 and exhaust port 21, as well as solenoids A and B controlling the pilot valves for main valves 16 and 17 respectively. The operation of valve assembly 11 will be as fully described in the aforementioned Sweet patent and need not be repeated here.

A switch housing 22 is mounted below valve assembly 11 and encloses switches LS1 and LS2. The contacts LS1-1 and LS1-2 and LS2-1 and LS2-2 are not shown in detail in FIGS. 2 and 3. However, they are controlled by an arm or lever 23 pivoted at 24 within housing 22 and extending upwardly therefrom. An intermediate portion of arm 23 controls a plunger 25 which is urged outwardly (to the right in FIG. 3). When plungers 25 are pressed inwardly (to the left in FIG. 3), switch contacts LS1-1 and LS2-1 are closed and switch contacts LS1-2 and LS2-2 are open, as shown in FIG. 1.

If either plunger 25 is permitted to move to the right under the influence of a spring means (not shown), then the position of the contacts will be reversed.

A roller 26 is mounted at the upper end of each arm 23 and is urged against a frustoconical cam 27 carried at the lower end of a plunger 28 carried by valve 16 or 17. This plunger extends downwardly from the valve stem through appropriate seals and bushings in the valve assembly housing. The arrangement of the parts is such that when the inlet valve element 29 of valves 16 or 17 is fully seated on its seat 31, then the wider portion of the corresponding cam 27 will press against roller 26 sufficiently to cause the switch contacts to be in their FIG. 1 position. However, as either valve member 29 leaves its seat 31 against the action of its spring 32, roller 26 will ride toward a smaller portion of cam 27 and cause the switch contacts to reverse. The reversed position of the switch contacts will be maintained all during the opening stroke of the valve and until the valve returns to its closed position as shown in FIG. 2. In the last increment of movement before reaching its fully closed position, cam 27 of the valve will again press lever 23 counterclockwise to return the switch contacts to their FIG. 1 position.

FIG. 4 shows a modified form of the invention in that it is applied to a parallel double valve assembly generally indicated at 101. This valve assembly comprises two normally closed three-way valves generally indicated at 102 and 103, similar to those described in the aforementioned Di Tirro et al U.S. Pat. No. 2,906,246. The function of this double valve assembly is basically the same as that previously described, the differences in action being described in the first portion of Sweet U.S. Pat. No. 3,757,818. The valve assembly has an inlet port 104, an exhaust port 105 and an outlet port 106, with flow from ports 104 to 106 being in parallel past both inlet valve elements 107, and flow from port 106 to 105 being in parallel past exhaust valve elements 108. Pressure to pistons 109 of the two valves is controlled by two three-way normally closed solenoid-operated pilot valves (not shown).

As before, plungers 111 are mounted on the lower portions of valves 102 and 103 and carry cams 112 which operate levers 113 of switches LS1 and LS2. The arrangement is such that, as described with respect to FIGS. 1, 2 and 3, the switches will be reversed immediately upon movement of valve element 107 from their seats, and will revert to their original position (FIG. 1) in the last increment of movement of elements 107 against their seats. The aforementioned advantages of this switch arrangement will accrue when the invention is applied to the parallel double valve assembly 101. The normally closed double valves will be monitored at the safe part of their cycle which is the closed position.

FIG. 5 shows a modified form of switch means as an alternative to the lever and plunger-operated switches described previously. This is in the form of a proximity switch 201 mounted on a housing portion 202 below the plunger extension 203 of the valve, the inlet valve element of which is indicated at 204. A steel target 205 is carried at the bottom of plunger 203, and proximity switch 201 may be vertically adjusted by its threaded mount 206 so that, upon the first increment of movement of valve element 204 away from its seat, target 205 will actuate switch 201, the reverse actuation being obtained during the last increment of movement before element 204 seats.

Figure 6:
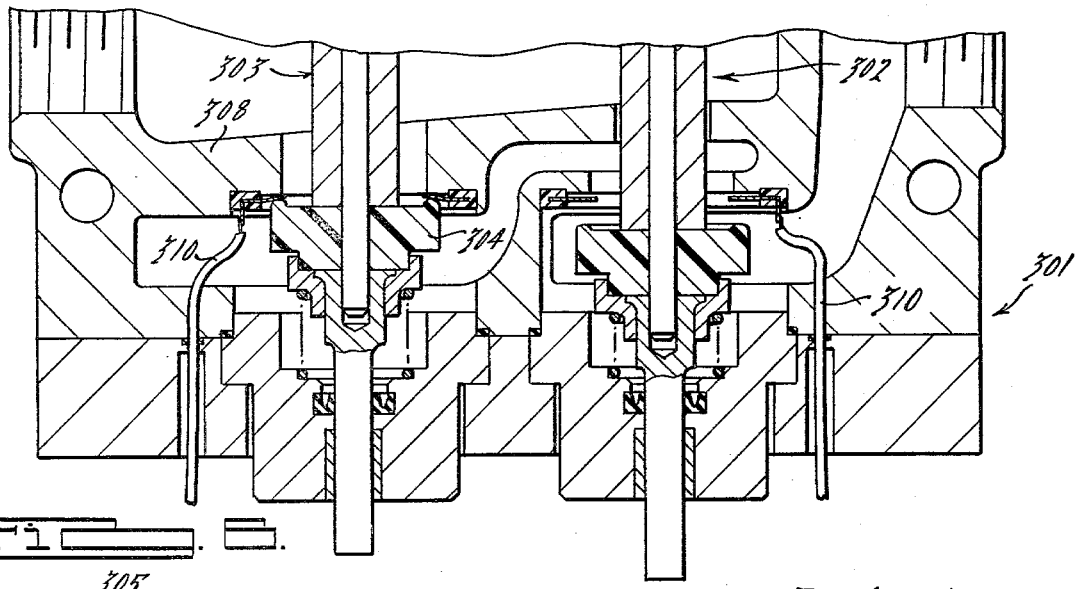
FIG. 6 is a partial cross-sectional view of still another embodiment of the invention showing an arrangement in which the electrical circuit for the two switch means utilizes the valve body, the contacts being engageable directly by the inlet valve elements.
Figure 7:
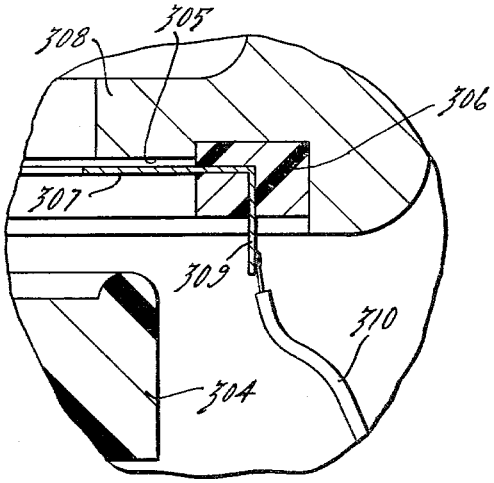
FIG. 7 is an enlarged fragmentary cross-sectional view taken in the area of FIG. 6 and showing the switch construction.

FIGS. 6 and 7 show still another modified construction in which the switch means contacts are directly actuated by the inlet valve elements themselves. In this embodiment, the double valve assembly is generally indicated at 301 and is of the series-parallel type shown in FIG. 2. The valves, generally indicated at 302 and 303, have inlet valve elements 304 of non-conductive material which would conventionally engage seats 305. In this case, however, a non-metallic insulating ring 306 is mounted adjacent and surrounding each seat 305, and carries an annular conductive spring disc 307 (FIG. 7) which is molded into ring 306. Spring disc 307 is closely adjacent to and parallel with seat 305 in its normal position but may be forced against seat 305 by valve element 304 so as to come into electrical contact with the seat, housing 308 being fabricated of electrically conductive material. Each disc 307 has a tab 309 connecting the disc to a lead wire 310.

In operation of the embodiment of FIG. 6, when the valves are closed they will be pressed against discs 307 creating a sealing effect. At this time discs 307 will be in electrical contact with seat 305 and therefore lead wires 310 will be electrically connected through the valve body. This closed electrical circuit will be sensed by a conventional comparing circuit shown schematically, FIG. 9, the comparing circuit in turn signalling the press control circuits.

Figure 8:
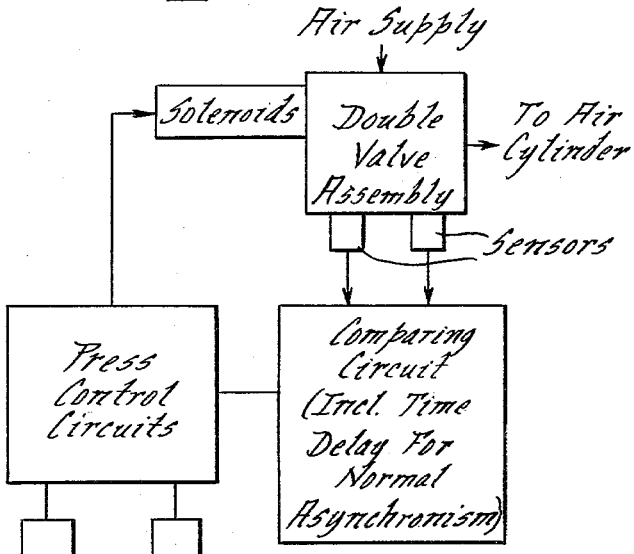
FIG. 8 is a partial cross-sectional view in elevation showing a double valve assembly which utilizes LED or photoelectric light sources for sensing, as another modification.

FIG. 8 shows still another modified form of the invention in which an LED or photoelectric light source 401 is used for sensing. In this embodiment the double valve assembly 402 has valves generally indicated at 403 and 404 which again are of the three-way normally closed poppet type. The plungers 405 at the lower ends of these valves are movable into and out of the paths of light sources 401, which have targets 406. When the individual inlet valve elements 407 are against their seats, the targets will receive the light from the light sources. During the first increment of movement of each valve element 407 away from its seat, its plunger 405 will move into the path of light from the light source and therefore cut out light impinging upon the target. The light will continue to be impinged until the last increment of movement of each inlet valve element 407 against its seat.

Figure 9:
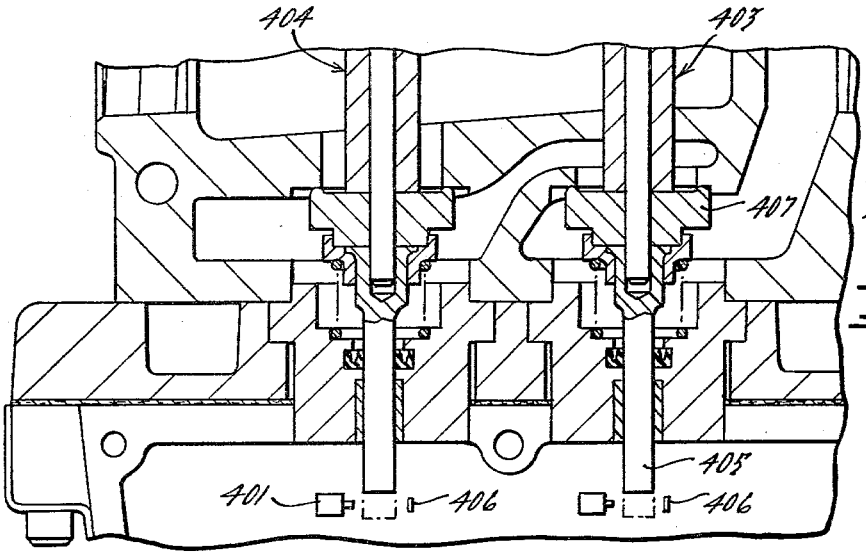
FIG. 9 is a schematic view showing how the mechanical switches, proximity switches, LED or photoelectric cell sensing means are connected to the press control circuits.

FIG. 9 shows in schematic fashion the manner in which the sensors, whether they be mechanically-operated switches as shown in FIGS. 2, 3, 4, 6 and 7, proximity switches as shown in FIG. 5, or LED or photoelectric cell switches as shown in FIG. 8, are connected to a comparing circuit which in itself is conventional, this comparing circuit controlling the press control circuits. The comparing circuit may include a time delay for normal asynchronism between the valves of the double valve assembly. The press control circuit will control current to these solenoids which operate the pilot valves for the double valve assembly.

I claim:

1. In combination with a poppet valve element movable toward and away from a seat, switch means comprising a spring-like conductive element mounted adjacent said seat and interposed between said element and seat, whereby said valve element will deflect said spring-like conductive element when it approaches said seat, and means connecting said conductive element to an electrical circuit.

2. The combination according to claim 1, said conductive element comprising an annular disc member, said valve element being non-conductive.

3. The combination according to claim 2, said seat being conductive, said conductive element engaging said seat when said valve element is closed.

4. The combination according to claim 1, said conductive element comprising a member which is separated from said seat when said valve element is away from said seat, and is pressed against said seat when said valve element approaches said seat.

* * * * *